US010159623B2

(12) United States Patent
Leftly

(10) Patent No.: US 10,159,623 B2
(45) Date of Patent: Dec. 25, 2018

(54) WEARABLE VIBRATION DEVICE

(71) Applicant: MYOVOLT LIMITED, Hong Kong (CN)

(72) Inventor: Steven Leftly, Lyttelton (NZ)

(73) Assignee: MYOVOLT LIMITED, Christchurch (NZ)

( * ) Notice: Subject to any disclaimer, the term of this patent is extended or adjusted under 35 U.S.C. 154(b) by 362 days.

(21) Appl. No.: 14/872,159

(22) Filed: Oct. 1, 2015

(65) Prior Publication Data

US 2016/0175187 A1 Jun. 23, 2016
US 2016/0302996 A9 Oct. 20, 2016

(30) Foreign Application Priority Data

Oct. 1, 2014 (GB) ..... 1417306.6

(51) Int. Cl.
*A61H 23/00* (2006.01)
*A61H 23/02* (2006.01)

(52) U.S. Cl.
CPC ..... *A61H 23/02* (2013.01); *A61H 2201/164* (2013.01); *A61H 2201/165* (2013.01); *A61H 2201/1619* (2013.01); *A61H 2201/1623* (2013.01); *A61H 2201/1635* (2013.01); *A61H 2201/5002* (2013.01); *A61H 2201/5035* (2013.01); *A61H 2201/5043* (2013.01); *A61H 2209/00* (2013.01)

(58) Field of Classification Search
CPC ..... A61H 23/02; A61H 2209/00; A61H 2201/5002; A61H 2201/165; A61H 2201/5035; B32B 2556/00
See application file for complete search history.

(56) References Cited

U.S. PATENT DOCUMENTS 3,710,784 A 1/1973 Taylor
4,732,140 A * 3/1988 Stoffregen ..... A61H 23/00 601/46

(Continued)

FOREIGN PATENT DOCUMENTS

DE 20301032 3/2003
EP 2022459 2/2009

(Continued)

*Primary Examiner* — Timothy Stanis
(74) *Attorney, Agent, or Firm* — Mark M. Friedman

(57) ABSTRACT

The present invention provides a novel wearable vibration device. According to an embodiment, the novel wearable vibration device delivering high energy vibration deep in to the muscles and soft tissues for muscle treatment comprising an upper soft fabric foam covered case encompassing at least a vibration motor a lithium ion battery, a control PCB, a control switch with LED display and a lower fabric covered case. The wearable vibration device delivers high energy vibration to the chosen muscle group and thereby, penetrates deep in to the muscle and to the soft tissues. The upper soft fabric foam covered case and lower fabric covered cases are fixed together by gluing or stitching. The control PCB drives vibration motor to set frequencies for vibration motor activations. Vibrations for the device are tuned at frequencies in the range of 30-50 Hz to increase muscle power and for other beneficial physiological effects.

11 Claims, 3 Drawing Sheets

(56) References Cited

U.S. PATENT DOCUMENTS

| | | | | |
|---|---|---|---|---|
| 4,846,157 | A * | 7/1989 | Sears | A63B 23/0244 340/573.7 |
| 5,158,075 | A * | 10/1992 | Howard | A61H 23/02 601/144 |
| 5,545,125 | A * | 8/1996 | Tseng | A61H 23/0263 601/70 |
| 5,764,776 | A * | 6/1998 | Francais | H04R 5/023 381/300 |
| 5,902,256 | A | 5/1999 | Benaron | |
| 6,537,235 | B1 | 3/2003 | Connor et al. | |
| 7,147,610 | B2 | 12/2006 | Maalouf | |
| 7,153,236 | B2 | 12/2006 | Gershman | |
| 7,182,739 | B2 | 2/2007 | Kopanic et al. | |
| 8,523,793 | B1 * | 9/2013 | Waldon, Sr. | A61H 23/02 601/46 |
| 9,384,639 | B2 | 7/2016 | White | |
| 9,452,101 | B2 | 9/2016 | Tomlinson et al. | |
| 2007/0255187 | A1 * | 11/2007 | Branch | A61F 7/02 601/15 |
| 2008/0195006 | A1 | 8/2008 | Stark et al. | |
| 2009/0076421 | A1 | 3/2009 | Grant, Jr. | |
| 2009/0177129 | A1 * | 7/2009 | Chan | A61H 23/0254 601/112 |
| 2010/0249637 | A1 | 9/2010 | Walter et al. | |
| 2012/0046579 | A1 * | 2/2012 | Radl | A61H 11/00 601/46 |
| 2012/0059294 | A1 | 3/2012 | Schubert | |
| 2012/0253236 | A1 | 10/2012 | Snow et al. | |
| 2013/0072835 | A1 | 3/2013 | Harry et al. | |
| 2013/0116606 | A1 | 5/2013 | Cordo et al. | |
| 2013/0204169 | A1 | 8/2013 | Poepperling et al. | |

FOREIGN PATENT DOCUMENTS

| | | |
|---|---|---|
| EP | 2177198 | 4/2010 |
| EP | 2727573 | 5/2014 |
| GB | 2515010 | 12/2014 |
| JP | 2009148521 | 7/2009 |
| WO | 2009044400 | 4/2009 |
| WO | 2010028042 | 4/2010 |
| WO | 2010127445 | 11/2010 |
| WO | 2013122870 | 8/2013 |
| WO | 2016051414 | 4/2016 |

* cited by examiner

WEARABLE VIBRATION DEVICE

FIELD OF INVENTION

The embodiments herein generally relate to wearable devices. More specifically, the embodiments described herein relate to a novel wearable vibration device for muscle treatment. Particularly, relates to a soft wearable module which delivers high energy vibration deep in to the muscles and soft tissues to increase blood flow circulation and as well as for lengthening and for stretching of the muscles.

BACKGROUND OF THE INVENTION

The latest, generation of healthcare devices are increasing an ability of humans to treat physical conditions in an instant moment. Nowadays, the merging of electronic devices with and around the human body is growing simple with most modern technologies. Many of the emerging devices to treat health problems are in the form of wearable or implantable technologies. In the current era, the tailoring of wearable devices can monitor as well as alleviate multiple health problems of humans.

Generally, muscle pain is the symptom of many diseases, disorders or injuries. The most common causes of muscle pain are due to injury, strain, using a muscle too much, too hard, a genetic disorder or a chronic tension. Various treatments are available to treat muscular disorders. Most significantly, passing vibrations in to muscles are very effective and act as an eminent tool for recovery and rehabilitation from such disorders. The intensities and frequencies of vibrations can be chosen based on the effects & types of the disorder.

Vibrations used on or into muscles works on the principle of frequency and amplitude. Furthermore, these vibrations can be adjusted to a specific body location and the energy can be transmitted to that location. Among a variety of effects, the vibrations can induce nuclei inside the cells to trigger the release of osteoblasts, which are needed to build bone.

Currently, wearable technology for muscular treatment is a growing field which ensures huge opportunities of innovation in the field of medical & fitness. Most of the wearable devices for muscular treatment are harder, bulkier and hand-held vibrating devices or fixed to a position, wherein a wearer is not able to move the body freely. Further, the wearable devices in the market provide relief to only certain specific regions and have no objective to directly transmit vibration into muscle and joint areas in a wearable format for specific treatment programs.

Therefore, there is a need for a novel wearable vibration device with modifications to overcome the problem associated with the prior art. Further, there is a need for a novel soft wearable vibration device to deliver vibration deep in to muscle and soft tissues and target vibration into the muscle and joint areas with respect to specific treatment programs, such as injury or fatigue recovery. Still, there is a need for a novel wearable vibration device suitable for a wide range of sports, recovery and therapy uses.

SUMMARY OF THE INVENTION

In view of the foregoing background, an embodiment herein provides a novel wearable vibration device. According to an embodiment, the novel wearable vibration device delivering high energy vibration deep in to the muscles and soft tissues for muscle or tissue treatment comprising an upper soft fabric foam covered case encompassing at least a vibration motor, a lithium ion battery, a control PCB, a control switch with optional LED display and a lower fabric covered case. The wearable vibration device delivers high energy vibration to the chosen muscle and thereby, penetrates deep in to the muscle and soil tissues. The upper soft fabric foam covered case and lower fabric covered cases are fixed together by gluing or stitching. Based on the selection of a program, the control PCB module sets frequency for vibration motor activations.

According to an embodiment, the wearable vibration device is held in a place lined up with the holes of an alignment strap and VELCRO® hook and loop fastener is tensioned to hold the wearable module firmly against the skin. The device can be able to bend in several planes to wrap around all body geometry parts. Vibrations for the device are tuned at frequencies, for example, in the range of 30-50 Hz to increase muscle power and for other beneficial physiological effects.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The detailed description is set forth with reference to the accompanying figures. In the figures the use of the same reference numbers in different figures indicates similar or identical items.

DETAILED DESCRIPTION OF THE PREFERRED EMBODIMENTS

Figure 1:
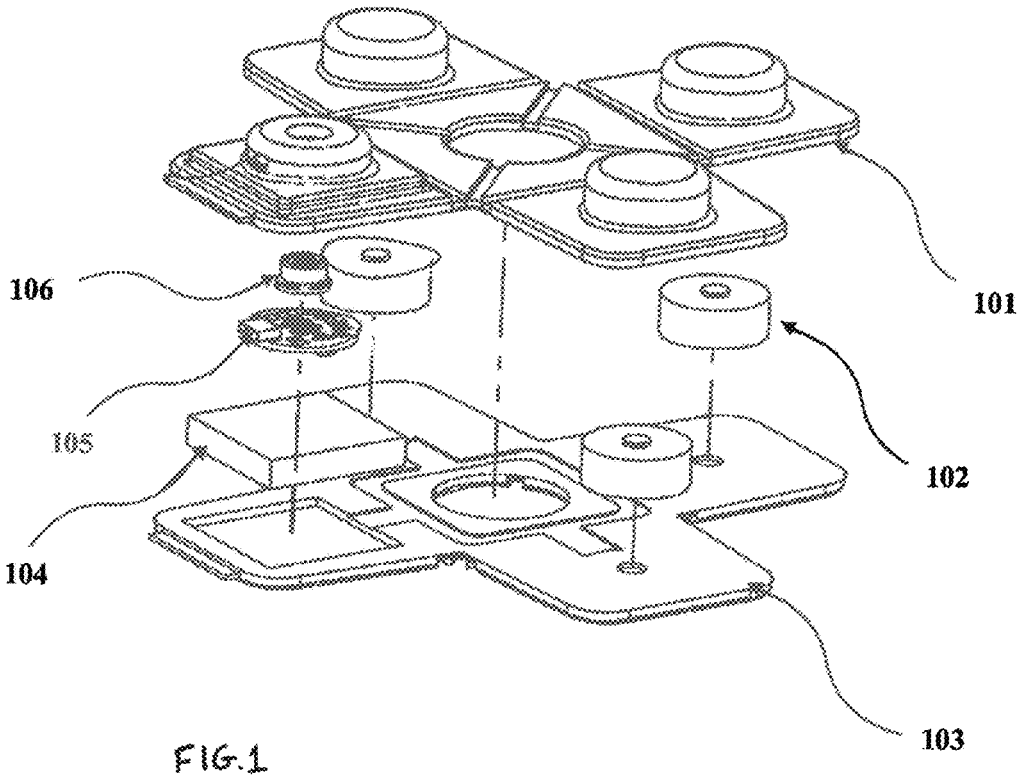
FIG. 1 illustrates an improved wearable vibration device, according to an embodiment therein.

The embodiments herein and the various features and advantageous details thereof are explained more fully with reference to the non-limiting embodiments and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

As mentioned above, there remains a need for a novel soft wearable vibration device to deliver high intensity vibration deep in to muscle and soil tissues and directly targets vibration in to the muscle and joint areas in a wearable format. The embodiments herein achieve this by providing a soft wearable vibration device inserted in a stretchable fabric, strap includes vibration motors, a control PCB, a control switch with LED display and a lithium ion battery. Referring now to drawings, and more particularly to FIGS. 1 through 3, where similar reference characters denote corresponding features consistently throughout the figures, there are shown preferred embodiments.

FIG. 1 illustrates an improved wearable vibration device, according to an embodiment. The improved wearable vibration device includes a soft fabric covered foam case upper 101 encases the internal components which comprise vibration motors 102, a lower fabric covered Ethylene Vinyl Acetate (EVA) case 103 encloses the device, a lithium ion battery 104, a control PCB 105 and a control switch pith LED display 106. The upper 101 and lower fabric 103 covered EVA cases are fixed together by gluing or stitching. The wearable vibration device is a soft wearable module that, delivers high energy vibration, deep into muscle and soft tissue. Further, the wearable vibration device can increase blood flow circulation, and as well as lengthening and stretching the muscles. The control PCB 105 manages the process of vibration based on the frequency.

According to an embodiment, the targeted frequency by the wearable vibration device can increase muscle power, increase circulation, warm up muscles, relax muscles and ligaments and may also reduce pain. In a preferred embodiment, the wearable vibration device is a soft, wearable and the vibration is focused to target specific body locations. Further, the wearable vibration device applies the vibration energy directly to the target muscle or deep tissue area by using three wearable actuators in the device module. Here, the energy is tuned at frequencies in the range of 30-50 Hz to increase muscle power and for other beneficial physiological effects.

According to an embodiment, the wearable vibration device is very simple to use and can be held in a place lined up with the holes of an alignment strap. Then, the device can be wrapped around the target muscle or limb area. After the VELCRO® hook and loop fastener is tensioned to hold the wearable module firmly against the skin, the device can be switched on. By pressing the control switch 106, the wearer can choose any one of the programs using control PCB 105 module enables to set frequencies for a sequence of vibration motor 102 activations.

In an embodiment, the wearable vibration device can be held in a neoprene alignment strap which enables the direction of the vibration energy to be focused at keys areas of the body and also limbs or joints. This means the user can apply the wearable vibration device directly to the chosen muscle group or to specific area of focus.

In an embodiment, the alignment straps are available for all the major muscle groups and joints can include but not limited to Quad/Hamstring, Multi-fit, Back/Abdominal, Arm/wrist & Shoulder straps of muscle groups and joints.

Figure 2:
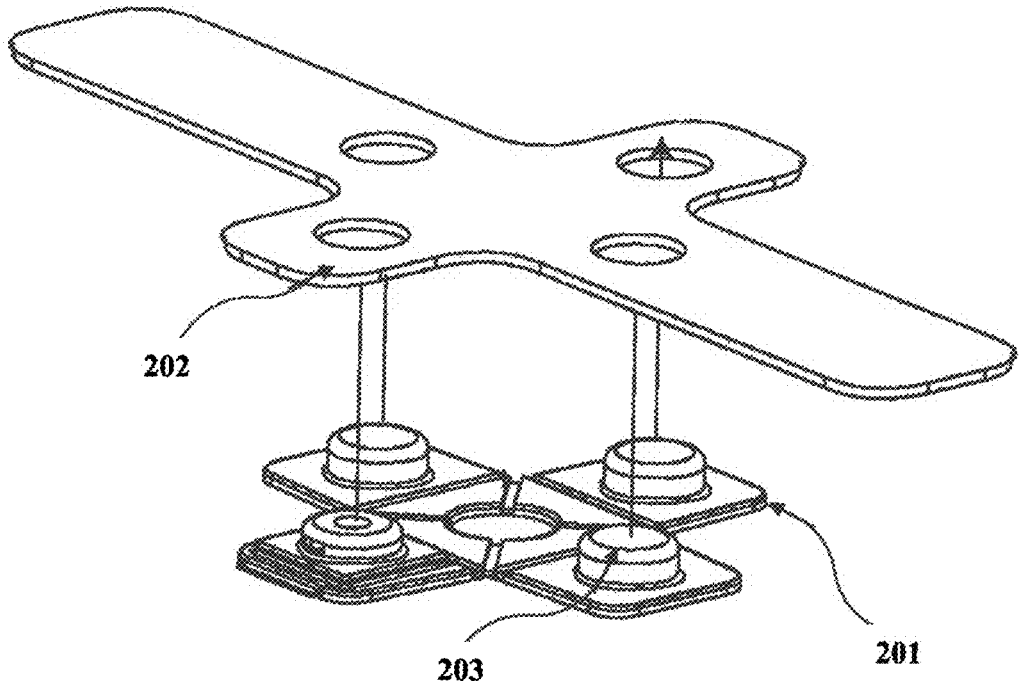
FIG. 2 illustrates a novel wearable vibration device inserted in a stretchable fabric strap, according to an embodiment therein.

FIG. 2 illustrates a novel wearable vibration device inserted in a stretchable fabric strap, according to an embodiment. The wearable vibration device 201 locks into the fabric strap using aligning cutout holes in the strap 202 which correspond with the motor cylinder shapes 203 on the device. In a preferred embodiment, the wearable vibration device is housed in vibration passage foam with soft fabric covering. According to an embodiment the device can be bent in several planes to wrap around all body geometry parts easily. The device shape has been designed for the comfort of the wearer and a convex polygon shape allows for multi-plane folding. Hence, the device can be wrapped easily around the body forms while keeping the flat surfaces required for vibration transmission.

According to an embodiment, the wearable vibration device can be used for muscle performance improvement, sports recovery tool and as a therapy tool. The wearable vibration device can improve muscle performance by warming up muscles and ligaments, providing more muscle power from startup, increasing localized circulation and helps to deliver more oxygen at a needed time and reducing risk of damage or injury by pre-warming muscles and joints.

As a sports recovery tool, the wearable vibration device increases circulation of targeted muscles for speeding up the removal of lactic acid, reduces swelling and provides gentle warm down massage to tired and sore muscles.

According to an embodiment, the wearable vibration device as a therapy tool reduces pain in muscles, ligaments and joints and further provides deep tissue vibration gently soothing any aches, strains without the power of heavy massage.

In an embodiment, the wearable vibration device can be used to warm up muscles and ligaments before and after training or playing games. Using the wearable vibration device can increase muscle power, blood circulation and may reduce injury risk. The wearable vibration device is a portable device which can be used in the gym, a race, during training, exercising or at anywhere and anytime. Further, the wearable vibration device can run for a longer duration and includes a rechargeable lithium ion battery 104 to provide power to the vibration motor 102.

Figure 3:
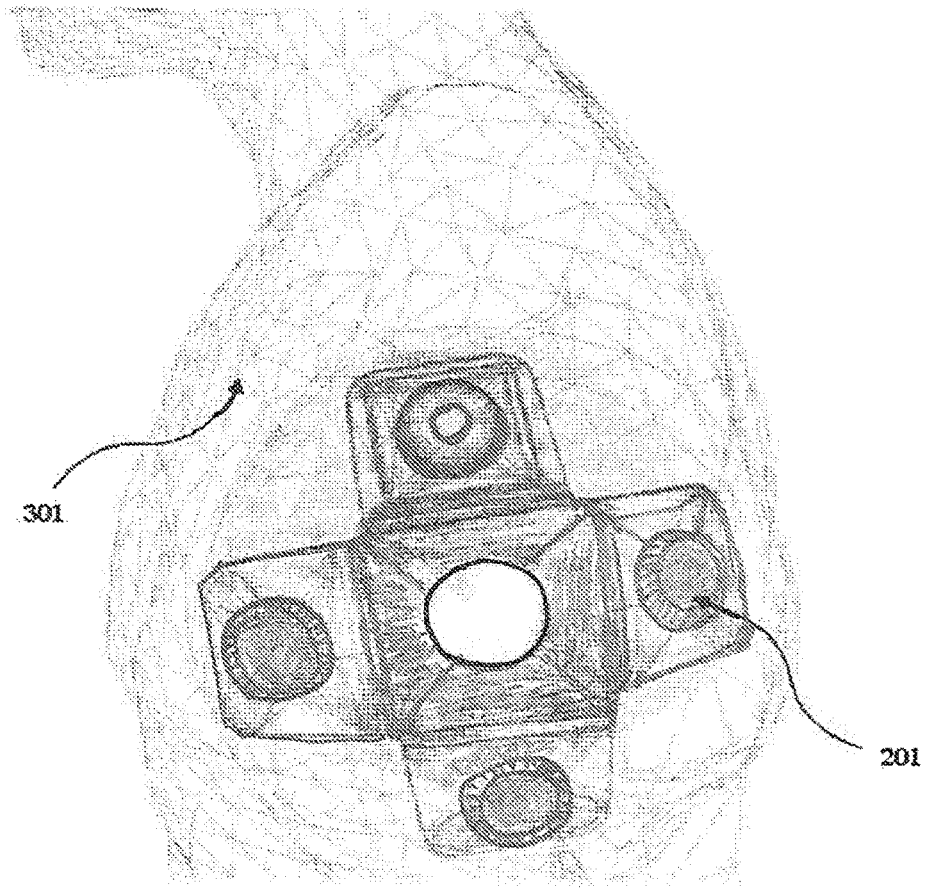
FIG. 3 illustrates a novel wearable vibration device placed on a human shoulder, according to an embodiment therein.

According to an embodiment, FIG. 3 illustrates a novel wearable vibration device placed on a human shoulder. The wearable vibration module 201 is placed in situ on a human shoulder location 301 is a series of fitted textile alignment straps to target all major muscle groups and joints so the wearer can target any and all areas. The straps are made of an elastic fabric, such as neoprene, with locating holes to position the module and lock in position.

According to an embodiment, the wearable vibration device can be placed and get locked in to a suitable position in the human body. The position to place the wearable vibration device can be determined by the wearer based on the location of the pain or disorder. Then the wearer can press control switch 106 and through the presence of the control PCB 105 module in the wearable vibration device allows the a wearer to select three pre-set treatment programs such as pre-exercise warm-up, post-exercise massage or in pulsing mode for pain relief. Based on the selection of the program enables the control PCB 105 module to set sequence for vibration motor activations. With the presence of the alignment strap facilitates the direction of the vibration energy to be focused directly to the chosen muscle group or to specific area of focus.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

The invention claimed is:

1. A wearable vibration device adapted to deliver high energy vibration deep in to muscles and soft tissues for muscle treatment comprising:

a housing comprised from an upper fabric foam cover and a lower fabric covered base, said housing adapted to bend in at least two planes to adhere to any surface area of a body part;

internal components including at least one vibration motor; a battery; a control printed circuit board (PCB), said internal components disposed in said housing;

an alignment strap with at least one cutout hole that corresponds to a shape of said at least one vibration motor, said housing adapted to be held in place by aligning said at least one cutout hole of said alignment strap with said at least one vibration motor.

2. The device of claim 1, wherein said upper fabric foam cover and said lower fabric covered base are fixed together by gluing or stitching.

3. The device of claim 1, wherein said high energy vibration is configured to be focused to target specific body locations and configured to penetrates deep in to the muscle and to the soft tissues.

4. The device of claim 1, wherein said high energy vibrations are tuned at frequencies in the range of 30-50 Hz to increase muscle power.

5. The device of claim 1, wherein said alignment strap holding said housing in place is adapted to be tensioned firmly against skin of a user by a hook and loop fastener.

6. The device of claim 1, wherein said control PCB is configured to set frequencies for a sequence of vibration motors activations.

7. The device of claim 1, wherein the device is adapted to be applied to a chosen muscle or to a specific area of any skin parts of a body.

8. The device of claim 1, wherein said device is configured to improves muscle performance and acts as a sports recovery tool and therapy tool.

9. The device of claim 1, wherein said housing is incorporated into a garment or fabric sleeve.

10. The device of claim 1, wherein said lower fabric covered base comprises vibration passage foam with soft fabric covering.

11. The device of claim 1, wherein said housing has a convex polygon shape.

* * * * *